US011285587B2

(12) United States Patent
Amend et al.

(10) Patent No.: US 11,285,587 B2
(45) Date of Patent: Mar. 29, 2022

(54) ADAPTIVE RADIAL SEAL REGULATOR

(71) Applicant: INGERSOLL-RAND INDUSTRIAL U.S., INC., Davidson, NC (US)

(72) Inventors: Ryan S. Amend, Easton, PA (US); Edward Charles Eardley, Easton, PA (US)

(73) Assignee: INGERSOLL-RAND INDUSTRIAL U.S., INC., Davidson, NC (US)

( * ) Notice: Subject to any disclaimer, the term of this patent is extended or adjusted under 35 U.S.C. 154(b) by 187 days.

(21) Appl. No.: 16/289,630

(22) Filed: Feb. 28, 2019

(65) Prior Publication Data

US 2020/0276688 A1 Sep. 3, 2020

(51) Int. Cl.

| | |
|---|---|
| ***B25B 21/00*** | (2006.01) |
| ***B25B 21/02*** | (2006.01) |
| ***B25B 23/145*** | (2006.01) |
| ***B25F 5/00*** | (2006.01) |
| ***B25F 5/02*** | (2006.01) |

(52) U.S. Cl.

CPC ..... *B25B 21/02* (2013.01); *B25B 23/1453* (2013.01); *B25F 5/005* (2013.01); *B25F 5/02* (2013.01); *B25B 21/002* (2013.01)

(58) Field of Classification Search

CPC ..... B25F 5/005; B25B 19/00; B25B 21/00; B25B 21/002; B25B 21/02; B25B 23/1453

USPC ..... 173/177

See application file for complete search history.

(56) References Cited

U.S. PATENT DOCUMENTS

2003/0121680 A1* 7/2003 Izumisawa ..... B25B 23/1405 173/93.5
2014/0231111 A1* 8/2014 Lehnert ..... B25F 5/005 173/1
2018/0339406 A1* 11/2018 Patel ..... B23Q 5/06

OTHER PUBLICATIONS

MAC Tools AWP099 1 inch Drive Pistol-Grip Handle Air Impact Wrench w/Flush Anvil. Datasheet [online]. MAC Tools Corporation, 2019 [relieved on Jull. 19, 2019]. Retrieved from the Internet: <URL: www.mactools.com/en-us/Power-Tools/Air-Drive-Tools/a67ffef8-2f87-4858-a1b6-a4f100e9955c/1-Drive-Impact-Wrenches/AWP099/1-Drive-Pistol-Grip-Handle-Air-Impact-Wrench-w-Flush-Anvil>.

* cited by examiner

*Primary Examiner* — Chelsea E Stinson
(74) *Attorney, Agent, or Firm* — Kevin E. West; Advent, LLP

(57) ABSTRACT

Improved radial pneumatic regulator systems, devices and methods are described herein. Embodiments may comprise regulators with adaptive radial seals to prevent air leakage, provide increased air supply use efficiency, and facilitate more efficient manufacture and assembly of systems. The regulator systems may be used in applications such as for pneumatic power tools.

16 Claims, 14 Drawing Sheets

ADAPTIVE RADIAL SEAL REGULATOR

The present invention relates to a regulator such as may be employed in a pneumatic tool. The regulator may comprise an adaptive radial seal that can adapt to sub-optimal part shapes while still achieving a good air seal. Additional features and advantages are also achieved.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The present invention relates to a novel and improved radial regulator such as may be used in a power tool utilizing compressed air as a motive force or otherwise using a hydraulic or liquid driven system.

Typical cylindrical regulators comprise a cylindrical regulator and cylindrical housing that need to rotate relative to one another to direct pressurized air or other gas to various flow channels and that rely on a tight radial fit between regulator and housing to provide a sealed environment with as minimal leakage of pressurized air as reasonably allowed. This required tight radial fit presents problems of rotation of the regulator and inherent leakage in the design due to manufacturing tolerances and part fitting.

One aspect of the present invention comprises the inclusion of a spring loaded member in the regulator that can adapt to out of round conditions in either or both of the regulator and/or the cylindrical housing and that can also provide a looser fit between the regulator body and the cylindrical housing thus accommodating manufacturing as well as operating ease while still achieving a higher level of air seal between the regulator and the cylindrical housing.

Another aspect of the present invention may comprise a radial seal regulator system, including a housing having a cylindrical opening having a central axis; a bushing configured to fit inside said cylindrical opening; a regulator having an axial length and a front end and a back end and configured to fit inside said bushing; said bushing having a first plurality of orifices disposed to open into a plane oriented generally proximate a medial section of the length of said regulator, and a second plurality of orifices disposed to open into a plane oriented generally proximate the front end of said regulator.

Another aspect of the present invention may comprise a radial seal regulator system, including a housing having a cylindrical opening having a central axis; a bushing configured to fit inside said cylindrical opening; a regulator having an axial length and a front end and a back end and configured to fit inside said bushing; said bushing having a first plurality of orifices disposed to open into a plane oriented generally proximate a medial section of the length of said regulator, and a second plurality of orifices disposed to open into a plane oriented generally proximate the front end of said regulator and wherein said first plurality of orifices includes a feed gas orifice for entry of feed gas into an axially central section of said regulator.

Another aspect of the present invention may comprise a radial seal regulator system, including a housing having a cylindrical opening having a central axis; a bushing configured to fit inside said cylindrical opening; a regulator having an axial length and a front end and a back end and configured to fit inside said bushing; said bushing having a first plurality of orifices disposed to open into a plane oriented generally proximate a medial section of the length of said regulator, and a second plurality of orifices disposed to open into a plane oriented generally proximate the front end of said regulator wherein said regulator comprises an axially central section comprising a first central cavity and a second central cavity.

Another aspect of the present invention may comprise a radial seal regulator system, including a housing having a cylindrical opening having a central axis; a bushing configured to fit inside said cylindrical opening; a regulator having an axial length and a front end and a back end and configured to fit inside said bushing; said bushing having a first plurality of orifices disposed to open into a plane oriented generally proximate a medial section of the length of said regulator, and a second plurality of orifices disposed to open into a plane oriented generally proximate the front end of said regulator wherein said regulator comprises an axially central section comprising a first central cavity and a second central cavity and wherein said first and central cavities are separated by a central gas director that extends along a diameter of said regulator.

BRIEF DESCRIPTION OF THE DRAWINGS

The accompanying drawings illustrate implementations of the concepts conveyed in the present application. Features of the illustrated implementations can be more readily understood by reference to the following description taken in conjunction with the accompanying drawings.

DETAILED DESCRIPTION

The following detailed description relates to the included Figures and various embodiments of the present invention.

Figure 1:
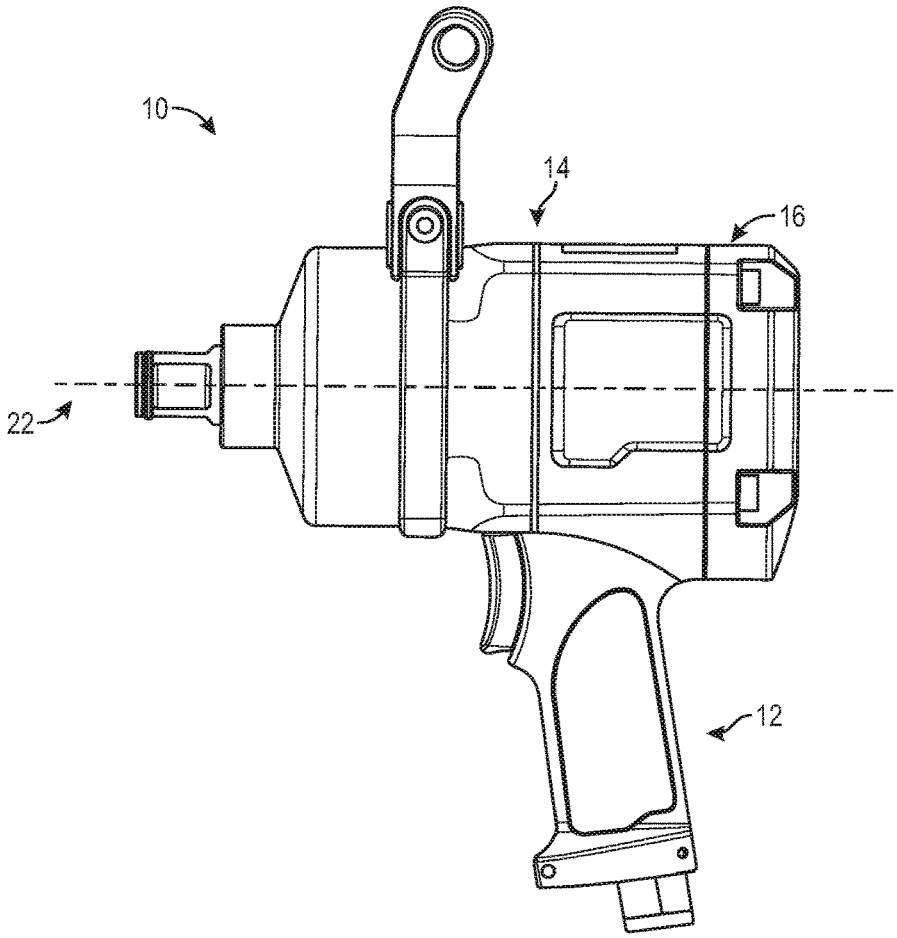
FIG. 1 illustrates an example representation of a power tool, in accordance with at least one embodiment.

FIG. 1 illustrates an exemplary representation of a power tool 10 in accordance of at least one embodiment of the present invention. As also shown in FIG. 1 the power tool 10 comprises a handle portion 12, and a drive body 14. The drive body 14 also comprises a back cap 16. Also shown in FIG. 1 is drive axis 22 of the power tool.

Figure 2:
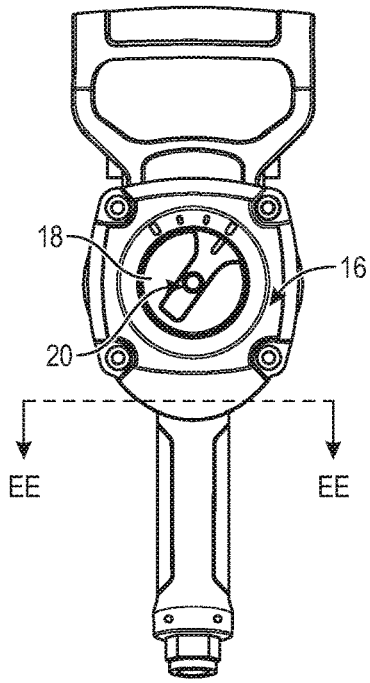
FIG. 2 illustrates an exemplary view of the rear exterior of the power tool of FIG. 1, in accordance with at least one embodiment.

FIG. 2 illustrates an exemplary view of the rear exterior of the power tool of FIG. 1, in accordance with at least one embodiment of the present invention. Shown in FIG. 2 is the back cap 16 and regulator 18. Located in the center of the back cap 16 is grease port 20. Back cap 16 may also be termed a housing.

Figure 3:
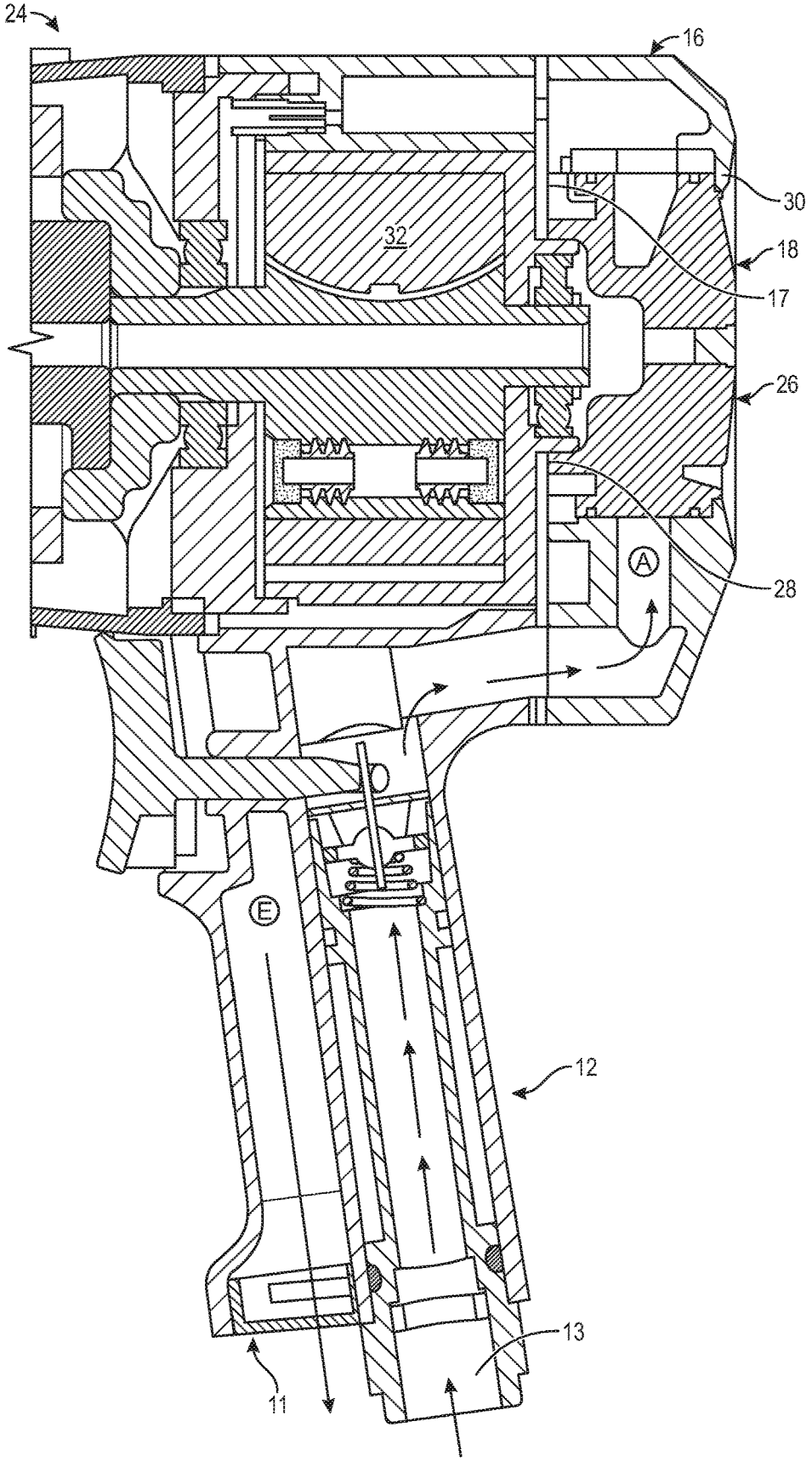
FIG. 3 illustrates a cross-sectional view of the handle and rear portion of the power tool of FIG. 1, in accordance with at least one embodiment.

FIG. 3 illustrates a cross-sectional view of the handle 12 and rear portion 24 of the power tool 10 of FIG. 1 in accordance with an embodiment of the invention. Also shown in cross-sectional view is regulator 18, back cap 16, and gasket 17. Regulator 18 comprises a back end 26 and a front end 28. Shoulder 30 of back cap 16, in some embodiments, may serve to retain regulator 18 in functional position inside back cap 16. Also shown is motor 32 of the power tool 10 as well as feed gas coupling 13 and exhaust gas passageway 11.

Figure 4:
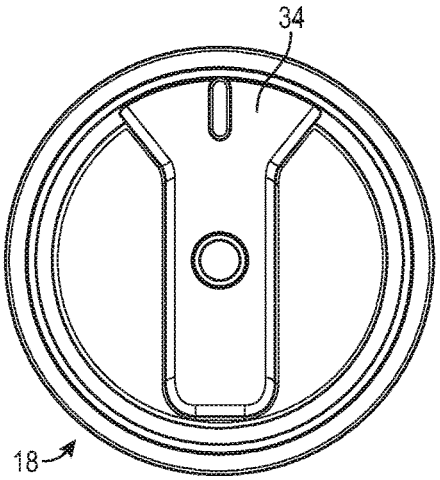
FIG. 4 illustrates a rear exterior view of a regulator, in accordance with at least one embodiment.
Figure 5:
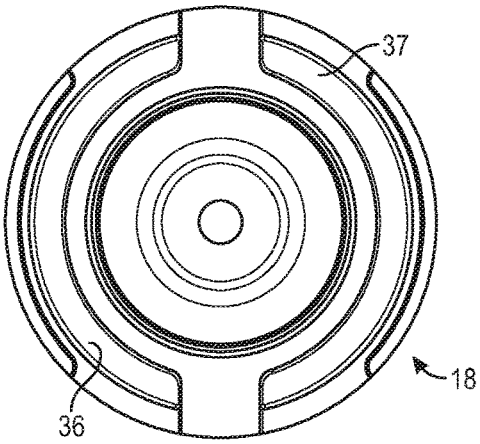
FIG. 5 illustrates a front view of the regulator of FIG. 4, in accordance with at least one embodiment.

FIG. 4 illustrates a rear exterior view of regulator 18 in accordance with at least one embodiment of the present invention. Shown is grip 34 to facilitate operator rotation of regulator 18. FIG. 5 illustrates a front view of regulator 18 in accordance with at least one embodiment. Shown are first air channel groove 36 and second air channel groove 37. First and second air channel grooves 36 and 37 may be used to channel exhaust gases in some embodiments. The terms "air" and "gas" or "gasses" are used interchangeably herein and embodiments of the present invention may operate with air or non-atmospheric mixtures of gasses.

Figure 6:
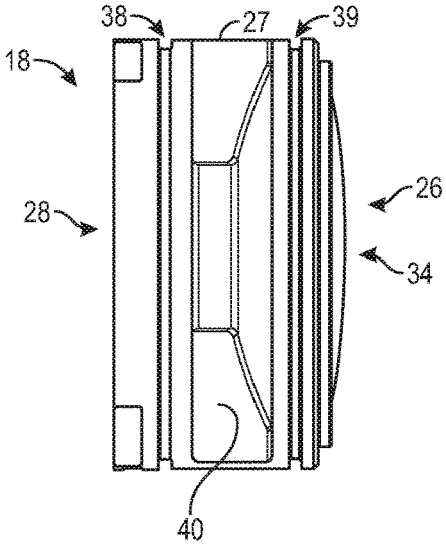
FIG. 6 illustrates a side view of the regulator of FIG. 4, in accordance with at least one embodiment.

FIG. 6 illustrates a side view of regulator 18 in accordance with at least one embodiment. Shown are regulator 18, back end 26, front end 28, first O-ring groove 38, second O-ring groove 39, as well as first central cavity 40 in central portion 27 of regulator 18.

Figure 7:
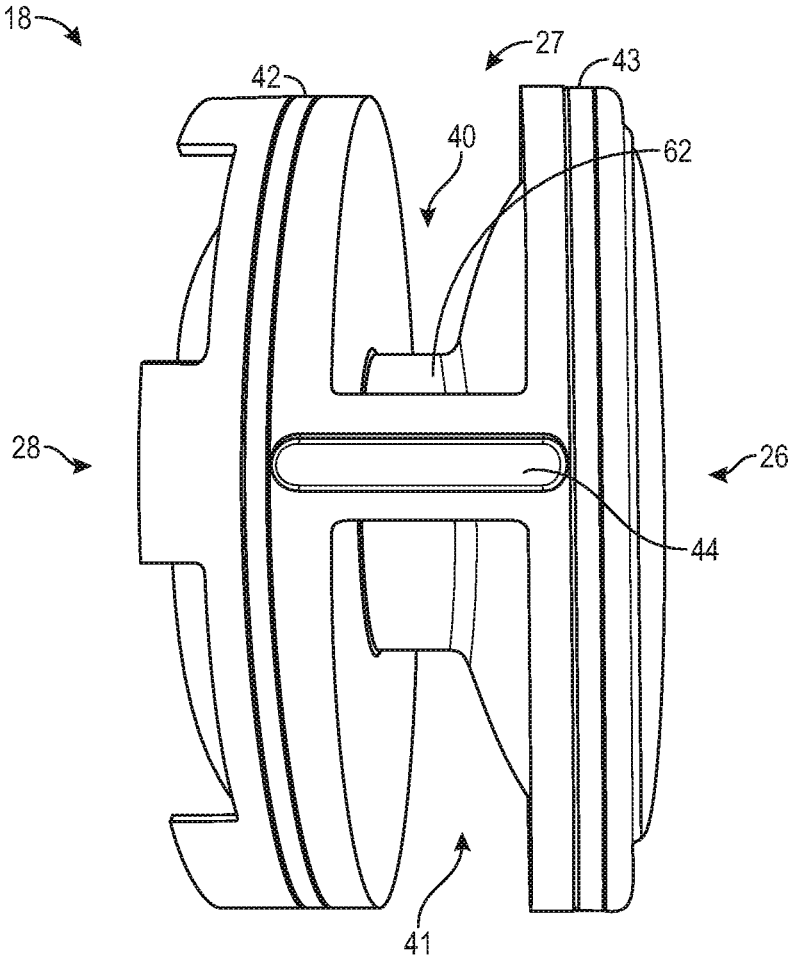
FIG. 7 illustrates an exemplary side view of the regulator of FIG. 6 with the regulator rotated 90 degrees from the view of FIG. 6, according to at least one embodiment.

FIG. 7 shows an exemplary top view of one embodiment of the regulator of FIG. 6 showing a view of the regulator rotated 90° from the view of FIG. 6 and that 90° rotation being in a clockwise direction from the perspective of FIG. 4. Central portion 27 of regulator 18 comprises two central cavities: first central cavity 40 and second central cavity 41. Regulator 18 also comprises central gas director 62. Also shown in FIG. 7 are first central cavity 40 and second central cavity 41 as well as first O-ring 42 and second O-ring 43. Also shown is first vane 44. In the embodiment shown in FIG. 7, first vane 44 does not extend in an axial direction so as to extend under first and second O-rings 42 and 43. O-rings 42 and 43 extend circumferentially around regulator 18 and are disposed, respectively, in O-ring grooves 38 and 39.

In some embodiments, the present invention comprises spring loaded vanes that provide optimal radial sealing between a regulator and an enclosing bushing or housing without requiring a tight OD/ID (outer diameter/inner diameter) clearance fit and which can adapt to out of roundness conditions in either or both of the regulator and/or enclosing bushing or housing.

Figure 8:
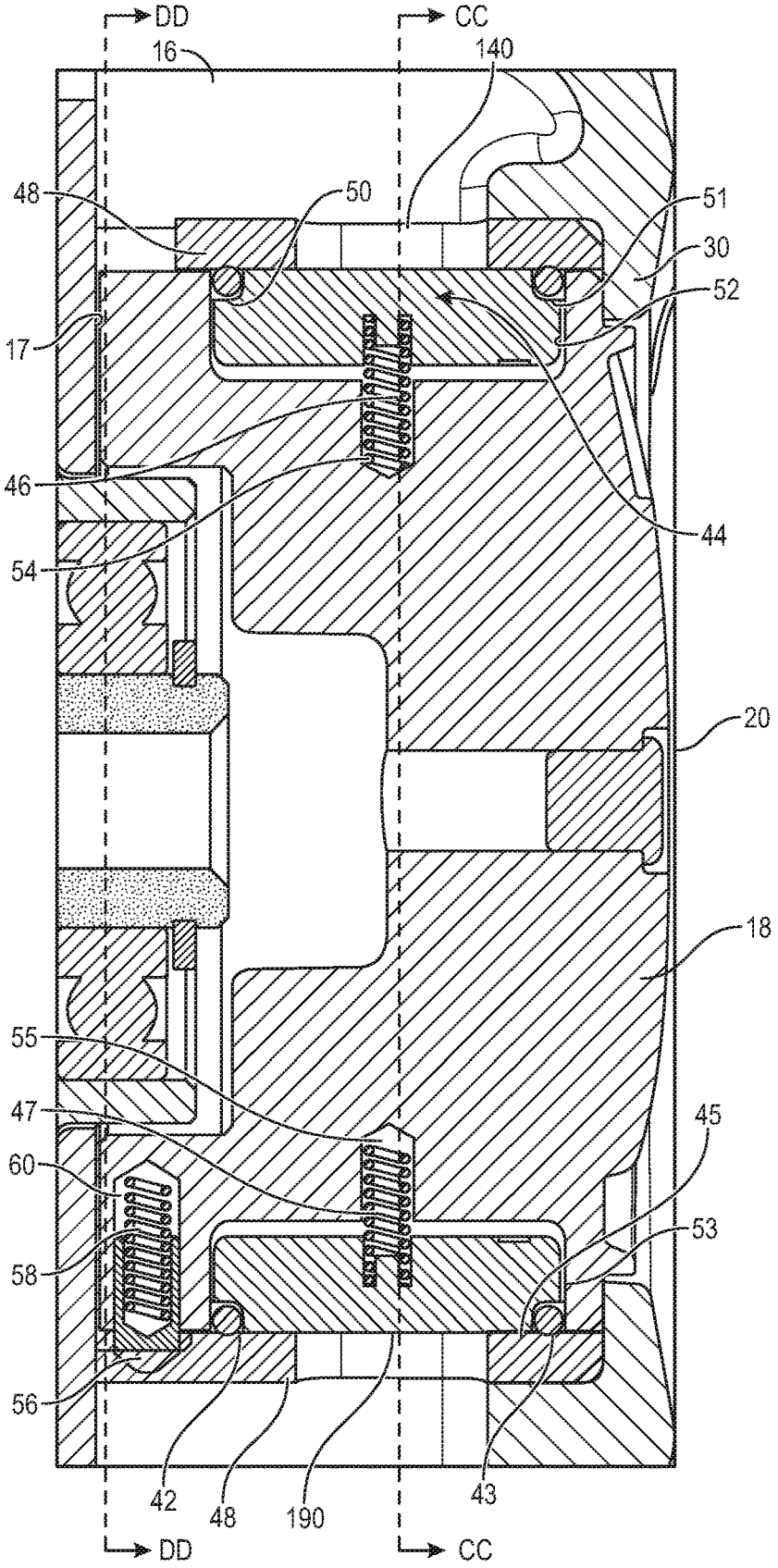
FIG. 8 illustrates a cross-sectional side view of a regulator, bushing and back cap, in accordance with at least one embodiment.

FIG. 8 illustrates a cross-sectional view of regulator 18, bushing 48, back cap 16 and shoulder 30. Also shown are first vane 44 and second vane 45 with associated first spring 46 and second spring 47. In the embodiment of FIG. 8, first and second springs 46 and 47 are compression springs. First vane 44 and second vane 45 are positioned respectively in first slots 52 and second slot 53 of regulator 18. First spring 46 and second spring 47 are positioned in first spring recess 54 and second spring recess 55. First and second springs 46 and 47, respectively, served to bias first and second vanes 44 and 45 in a radially outward direction towards bushing 48 where first and second vanes 44 and 45 seal against the radial inner surface 78 of bushing 48. In the embodiment of FIG. 8 first vane 44 and second vane 46 extend in an axial direction towards back end 26 and front end 28 of regulator 18 so as to subtend first O-ring 42 and second O-ring 43. It should be noted that in another embodiment, that of FIG. 7, neither first nor second vanes 44 or 45 extend in an axial direction underneath first O-ring 42 and second O-ring 43.

Figure 19:
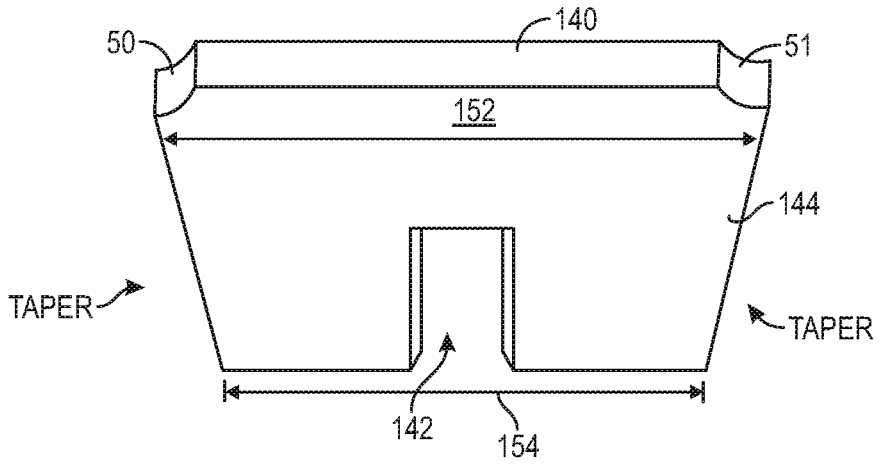
FIG. 19 illustrates a perspective view of a vane, in accordance with at least one embodiment.
Figure 20:
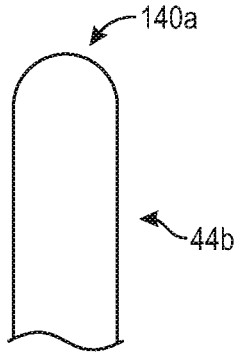
FIG. 20 illustrates a side view of a vane, in accordance with at least one embodiment.
Figure 21:
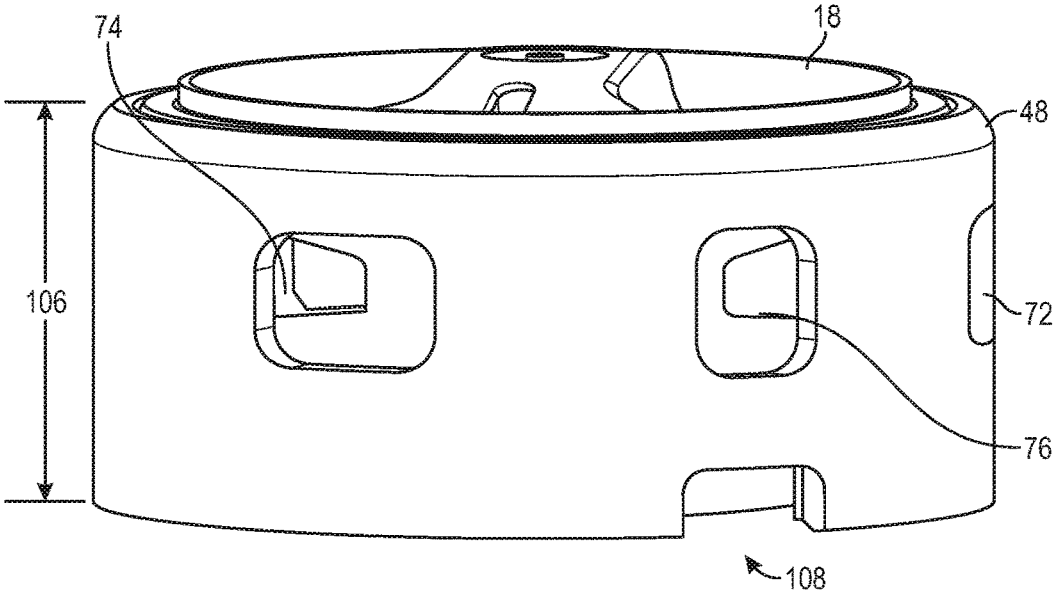
FIG. 21 illustrates a side view of the bushing and regulator assembly of FIG. 13 in a slightly rotated view, in accordance with at least one embodiment.

In the embodiment of FIG. 8 first vane 44 comprises first notch 50 and second notch 51 which align with first O-ring groove 38 and second O-ring groove 39 to accommodate correct positioning of O-rings 42 and 43. Similarly second vane 45 comprises third notch 80 and fourth notch 81 which align with first O-ring groove 38 and second O-ring groove 39 to accommodate correct positioning of O-rings 42 and 43. As also shown in FIG. 19, each of vanes 44 and 45 comprise a vane sealing surface 140 that bears against the radial inner surface 78 of bushing 48. In some embodiments the vane may comprise more than one material, and in some embodiments may have a separate material that comprises the vane sealing surface 140, in some embodiments such surface may be a rubberized material. Vane sealing surface may be planar and generally perpendicular to vane side wall 144. Further, each of vanes 44 and 45 may comprise a spring seating slot 142. As shown in FIG. 20, vanes also may comprise a vane sealing surface which has a rounded profile when viewed in cross-section.

Further, in the embodiment shown in FIG. 8, O-rings 42 and 43 may facilitate efficient assembly of the regulator 18, bushing 48 and other subassemblies into back cap 16. Due to leakage concerns and tolerance requirements a regulator assembly of certain embodiments of the present invention may present difficulties in assembly. However, in certain embodiments enabled by the biased vane structure of certain embodiments, assembly complications may be significantly reduced. Also, since greater per piece tolerances can be accommodated by the biased vane assembly per piece cost of components of certain embodiments can be greatly reduced. O-rings 42 and 43 serve to hold vanes 44 and 45 in slots 52 and 53 during assembly of regulator 18 into bushing 48. In other words, during assembly, springs 46 and 47 may be inserted into spring recesses 54 and 55, then vanes 44 and 45 may be inserted into slots 52 and 53, then O-rings 42 and 43 may be placed in O-ring grooves 38 and 39 and across notches 50 and 51 thereby retaining vanes 44 and 45 in slots 52 and 53 while yet allowing vanes 44 and 45 to be spring biased radially against radial inner surface 78 a bushing 48 when the assembly of regulator, springs, vanes and O-rings are inserted into bushing 48. The completed assembly of regulator 18 and bushing 48 can then be inserted into back cap 16 and retained in an axial direction by shoulder 30. Thereafter, back cap 16 can be attached to the power tool 10 as shown in FIG. 3 as part of rear portion 24. In other words, embodiments of the present design create their own retention of vanes in their respective slots during assembly.

In various embodiments, vanes 41 and 42 can be of varying lengths. In some embodiments the vanes do not extend in an axial direction to touch the O-rings and in some embodiments the vanes may extend to meet the O-rings. In some other embodiments, the O-rings may extend to subtend the O-rings. In other embodiments they may extend beyond notches 50 and 51 to extend axially outward beyond the O-rings towards either or both of back end 26 and/or front end 26 of bushing 48.

Figure 18:
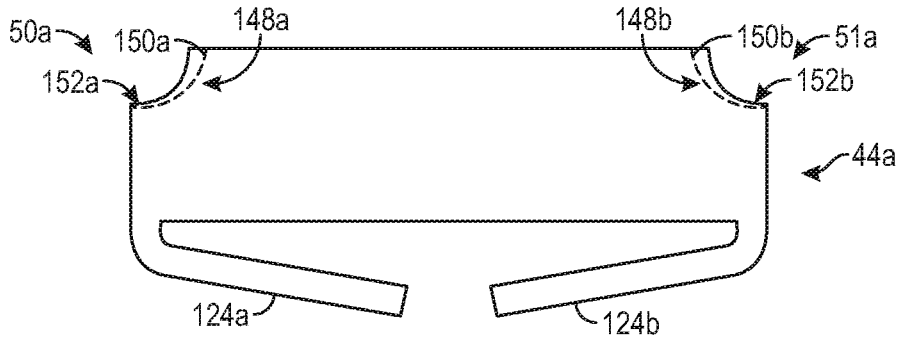
FIG. 18 illustrates an integrally formed vane and biasing members, in accordance with at least one embodiment.

Varying embodiments of springs 46 and 47 may be used in varying embodiments of the present invention. In the embodiment of FIG. 8, the springs comprise compression springs. In some embodiments the springs may comprise slice leaf springs or torsion springs. In some embodiments each vane may be radially biased in an outward direction by two or more springs paired laterally along each of slots 52 and 53. In another embodiment a radially outward pressure can be created by forming the vanes by an integral molding process whereby each vane is integrally molded to have a radially inward flexible or resilient portion that maintains the vanes, when mounted in slots 52 and 53, in a radially outward biased fashion toward the radial inner surface 78 of the bushing 48. When the integrally molded vane is inserted into its respective notch, the flexible portion of the vane serves to create a biasing force in a radially outward direction. An illustrative example of such an integrally molded vane is shown in FIG. 18 which shows a vane 44*a* with two resiliently flexible arms 124*a* and 124*b* which create the desired biasing force when vane 44*a* is inserted into slot 52 or 53. Other methods may also be used to create a radially biasing force pushing the vanes against the radial inner surface 78 of bushing 48. FIG. 18 also shows another feature of certain embodiments. Shown (by dotted lines) are asymmetric notches 148*a* and 148*b*. In these asymmetric notches that portion 150*a* and 150*b* of the notch near where it meets with vane sealing surface 140 is not circular with a constant radius to the curve of the notches 148*a* and 148*b*. Instead portions 150*a* and 150*b* have a more vertical orientation rather than circular. This orientation facilitates the radially outward movement of the vanes and limits the possible tendency of the vanes to be stuck with possible compression of O-rings 42 and 43 and thus limited in the vanes' freedom to move radially outward. The lower portion 152*a* and 152*b* of the asymmetric notches 148*a* and 148*b* are more circular in shape and are thus configured to readily seal against O-rings 42 and 43 to prevent air pressure leaks.

In certain embodiments of the present invention the vanes seal against a bushing or housing surface and are biased in a radially outward direction. In other embodiments vanes may be positioned in a radially inward biased orientation to bear against a sealing surface such as a bushing, regulator, or other structure or component.

Also shown in FIG. 8 is detent pin 56, detent spring 58 and detent cavity 60. The detent assembly functions with either bushing 48 or back cap 16 to provide tactile feedback to a user of the power tool 10 as grip 34 and regulator 18 is rotated through various preset points of rotation such as those shown in FIG. 15. Other methods or systems may also be used to hold regulator 18 in various preset points of rotation.

Figure 9:
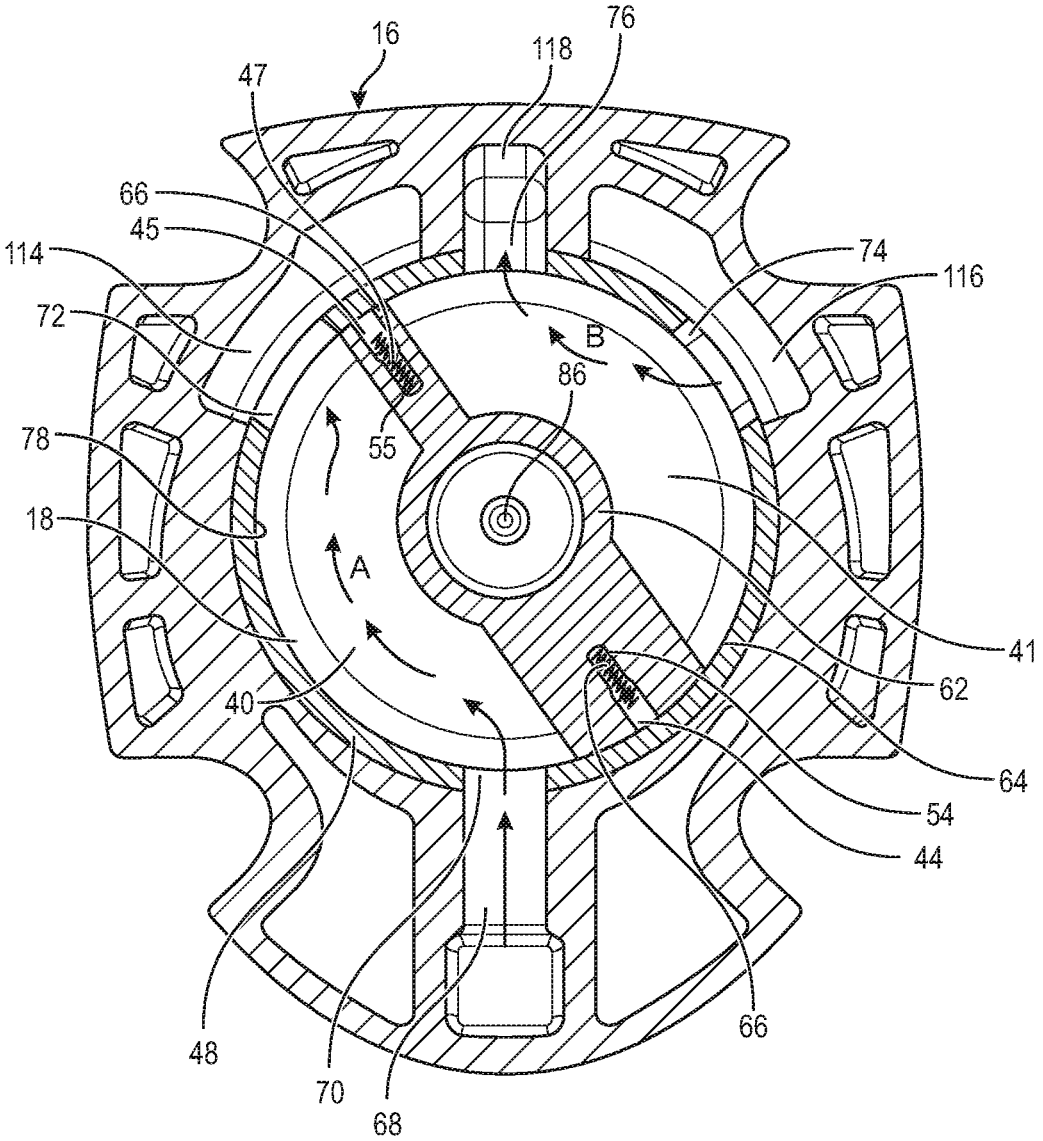
FIG. 9 illustrates a cross-sectional front view of a regulator, bushing, and back cap with the regulator in the forward high power position, in accordance with at least one embodiment.
Figure 15:
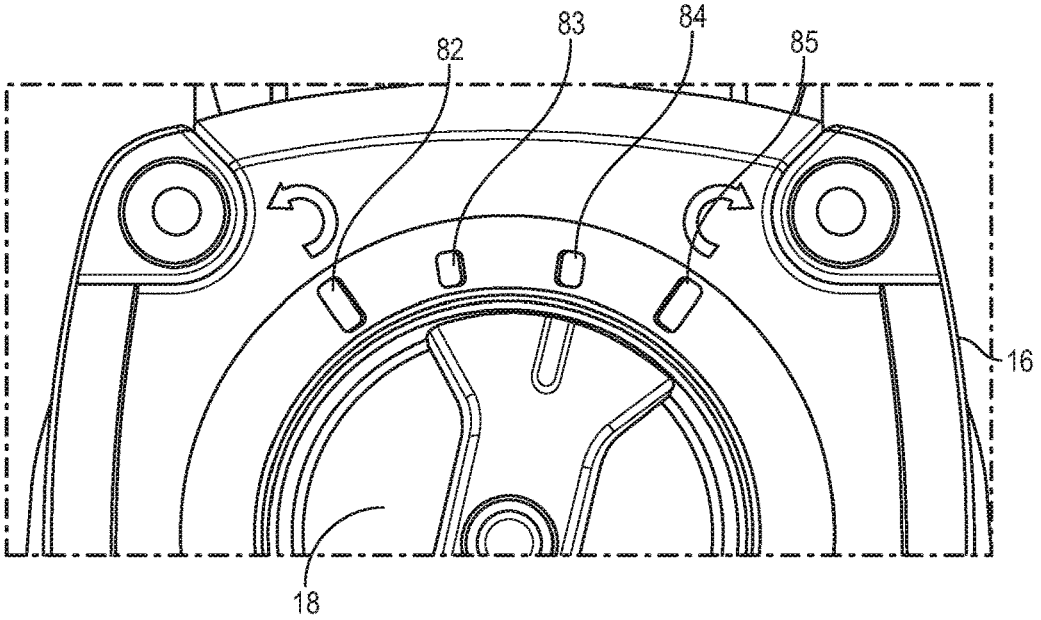
FIG. 15 illustrates an enlarged rear view of the power tool and regulator of FIG. 1, in accordance with at least one embodiment.

FIG. 9 illustrates a cross-sectional front view taken along the line CC of FIG. 8 of regulator 18, bushing 48, and back cap 16 with the regulator in the forward high power position 82 of FIG. 15.

Also shown in FIG. 9 is a cross-sectional view of the central portion 27 of regulator 18. In the central portion 27 is included central gas director 62 which has a first-end 64 and a second end 66. Central gas director 62 rotates around axis 86 of central gas director 62 which may be parallel to drive axis 22. Also shown in cross-sectional view at first end 64 are first vane 44 first spring 66 and first spring recess 54. Similarly shown at second end 64 are second vane 45, second spring 47, and second spring recess 55. On opposite sides of central gas director 62 are first central cavity 40 and second central cavity 41. As also shown in this embodiment, back cap 16 also comprises feed gas channel 68, second gas channel 114, third gas channel 116, and fourth gas channel 118. Also shown in cross-sectional view are certain elements of bushing 48 including first gas directing orifice 72, second gas directing orifice 74, and third gas directing orifice 76.

When, as shown in FIG. 9, the regulator 18 is set to forward high power position 85 pressurized air or feed gas is directed through feed gas channel 68, through feed gas orifice 70 into central portion 27 and, more particularly, to first central cavity 40. This pressurized gas is contained or directed in first central cavity 40 between central gas director 62 and the radial inner surface 78 of bushing 48 and then proceeds to exit regulator 18 through first gas directing orifice 72 into second gas channel 114 of back cap 16 from whence the gas is directed to the pneumatic motor 32 of power tool 10. The flow of feed gas in FIG. 9 is shown by arrow A. After the feed gas has been directed to the motor 32 of the power tool 10 and provided power to the power tool 10, the exhaust gas from the motor 32 may be directed to second gas channel 116 of back cap 16, through second gas directing orifice 74 and enters second central cavity 41. This exhaust gas may then be directed between the central gas director 62 and the radial inner surface 78 of bushing 48 until being directed out through third gas directing orifice 76 into fourth gas channel 118 of back cap 16. As described in relation to FIG. 10, this exhaust gas may then be passed through first air channel groove 36 and eventually discharged from the power tool via exhaust gas passageway 11. The flow of the exhaust gas in FIG. 9 is shown by arrow B.

As can be seen in FIG. 9 first vane 44 and second vane 45 seal against the radial inner surface 78 of bushing 48 and prevent the flow of gas from first central cavity 40 into second central cavity 41. Instead, the flows of gas are directed, as feed gas, (in the setting of FIG. 9) out the first gas directing orifice 72 and then, as exhaust gases, out the third gas directing orifice 76. The seal, and in some embodiments, resiliency of vanes 44 and 45 radially biased outwardly against the relatively smooth and consistent radial inner surface 78 of bushing 48 provide an efficient seal preventing the flow of gas across the interface of first end 64 or second end 66 of central gas director 62 with the radial inner surface 78 of bushing 48. Additionally, first and second O-rings 38 and 39 serve to prevent the flow of gas in an axial direction out of first central cavity 40 and second central cavity 41.

In some embodiments, the regulator 18 is positioned inside back cap 16 without the use of a bushing. In such embodiments vanes 44 and 45 still serve to provide an efficient seal preventing the flow of gas across the interface of first end 64 or second end 66 of central gas director 62 with the inner radial surface 126 of back cap 16. In these embodiments too, first and second O-rings 38 and 39 serve to prevent the flow of gas in an axial direction out of first central cavity 40 and second central cavity 41.

Certain embodiments utilizing bushing 48 provide fabrication and assembly advantages since the various orifices in bushing 48 can be easily and precisely milled or created. In certain embodiments, back cap 16 may comprise cast aluminum, the fabrication of which may lead to certain imprecision in the fit between the inner radial surface 126 and a regulator not having the configuration and elements of the present invention. Use of a bushing allows for more simplified back cap design and manufacturing processing as well as allowing greater casting tolerances in back cap 16 while still providing precise gas flow orifice sizing and location in the bushing. Use of a bushing also may provide a more uniform internal shape, surface consistency and circumference than may be provided by embodiments using on a cast back cap mated with a regulator without a bushing.

Figure 10:
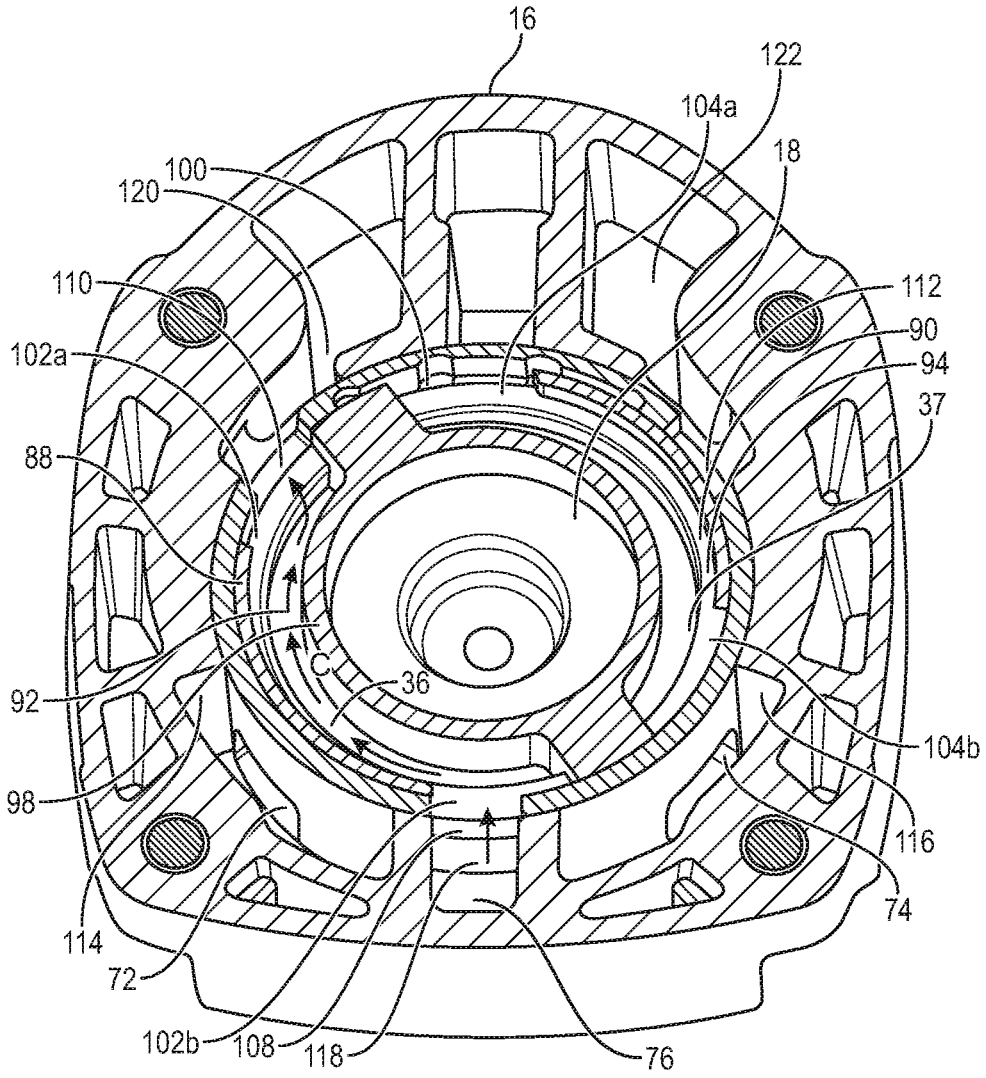
FIG. 10 illustrates an oblique perspective of a front view of a regulator, bushing, and back cap with the back cap not attached to the drive body, in accordance with at least one embodiment.

FIG. 10 illustrates an oblique front interior cross-sectional view of end cap 16 and regulator 18 along line DD of FIG. 8. Also shown in FIG. 10 are first shoulder 88 and second shoulder 90 of the front end 28 of regulator 18. First and second shoulders 88 and 90 are arcuate partially circumferential shoulders that extend partially along the radial periphery of the front end 28 of regulator 18. Radially internal to the first and second shoulders 88 and 90 is inner sealing shoulder 98. Extending partially circumferentially between inner sealing shoulder 98 and first and second shoulders 88 and 90 are respectively first air channel groove 36 and second air channel groove 37 which define, respectively first exhaust channel 92 and second exhaust channel 94. First shoulder 88 extends along the periphery of regulator 18 between first shoulder openings 102*a* and 102*b*. Second shoulder 90 extends along the periphery of regulator 18 between first shoulder openings 104*a* and 104*b*. In FIG. 10 regulator 18 is positioned at forward high power position 85. When the assembly of FIG. 9 is assembled to drive body 14, the axial surfaces of first and second shoulders 88 and 90 as well as of inner sealing shoulder 98 mate against gasket 17 completing definition of sealed air passageways along first and second air channel grooves 36 and 37 respectively.

FIG. 10 shows first shoulder opening 102*a* fully aligned with fifth gas directing orifice 110 and first should opening 102*b* fully aligned with fourth gas directing orifice 108. In the regulator setting of FIG. 10, exhaust gases from motor 32 may be directed to second central cavity 41 (as described in relation to FIG. 9) and then to fourth gas channel 118. From fourth gas channel 118 the exhaust gases may be directed through fourth gas directing orifice 108 (shown in FIG. 10) into and through first air channel groove 36, out first shoulder opening 102*a*, through fifth gas directing orifice 110 and into fifth gas channel 120 and from there directed to exhaust gas passageway 11. The flow of exhaust gas through first air channel groove 36 as described in conjunction with FIG. 10 is shown by arrows C. (When regulator 18 is set in the reverse positions 82 and 83, the exhaust gas flow is from the motor 32, to second gas channel 114, through first gas directing orifice 72, through first central cavity 40, through third gas directing orifice 76, through fourth gas channel 118, through fourth gas directing orifice 108, through second air channel groove through sixth gas directing orifice 112, and out sixth gas channel 122 to exhaust gas passageway 11. Thus the flows of feed and exhaust gasses are mirrored in the central section 27 and front end 28 depending on whether regulator 18 is set at either a forward or reverse setting.)

In certain embodiments the regulator may be configured in conjunction with the bushing such that no vanes overlap any of the central portion 27 orifices at any of the preset positions (such as exemplarily shown in FIG. 15). Further, in some embodiments the area of feed gas orifice 70 is smaller than the areas of either first or second gas directing orifices 72 or 74. In some embodiments the area of third gas directing orifice 76 is smaller than the areas of either first or second gas directing orifices 72 or 74.

While typical regulators may adjust the amount of pressurized gas or liquid flowing through the regulator, most of these are single purpose systems that only adjust the amount of pressurized gas or liquid flowing. In such instances a second device, system or switch is necessary to switch operation of the end device from a forward to a reverse operation. Embodiments of the present invention solve this inefficiency and do it in a novel way. By simple rotation of regulator 18 an operator simultaneously changes the direction of operation (from reverse to forward or vice versa), but also by the same action of simple rotation adjusts the amount of pressurized gas or liquid flowing through the regulator.

Figure 16:
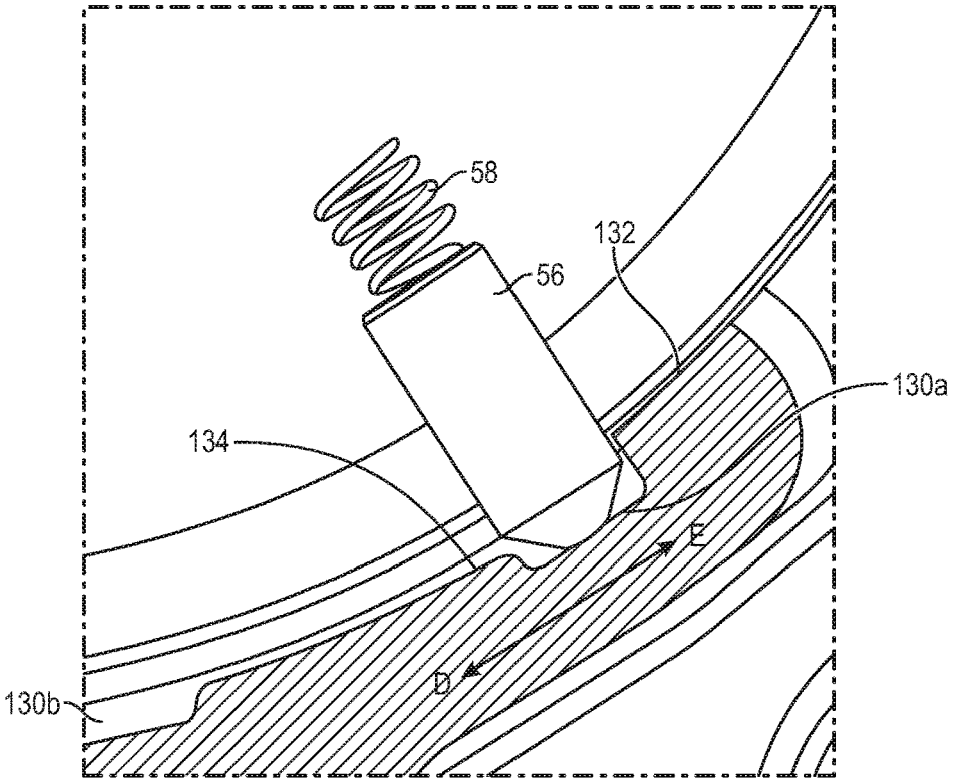
FIG. 16 illustrates an example of a detent system, in accordance with at least one embodiment.

FIG. 10 also shows detent receiver section 100 as shown in partial view in FIG. 16.

Figure 17A:
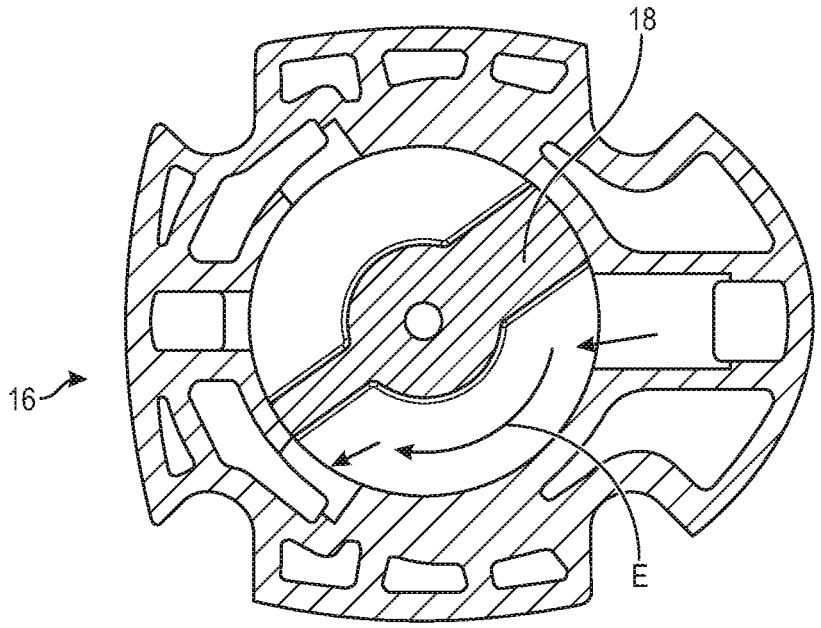
FIG. 17*a*-17*d* illustrate cross sectional views of assemblies and gas flows at various power settings.
Figure 17B:
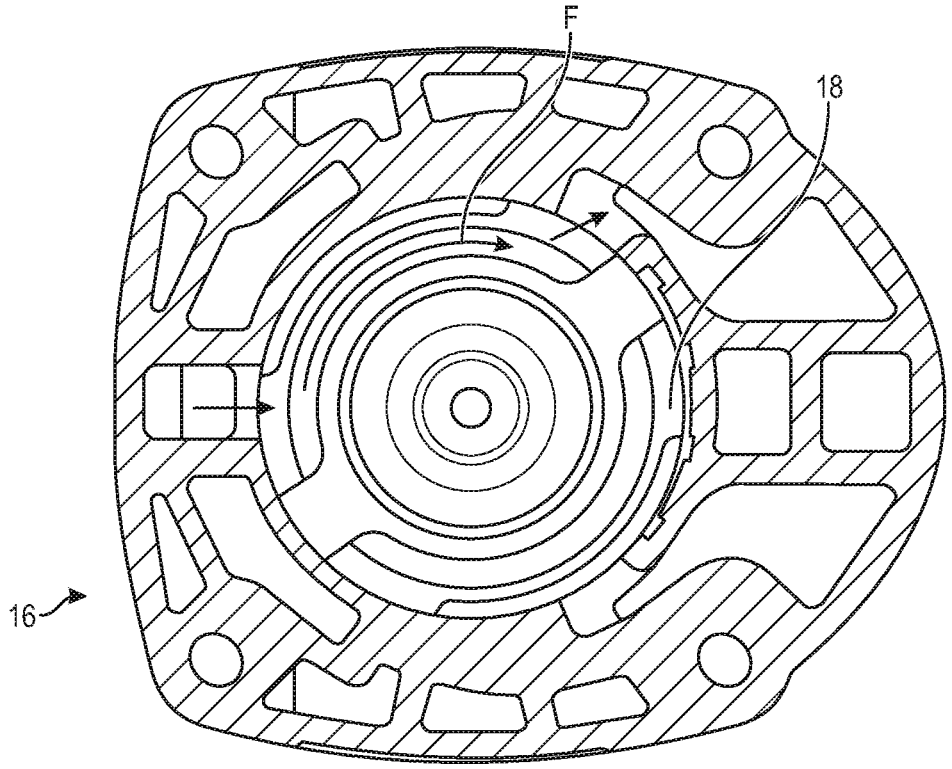
Figure 17C:
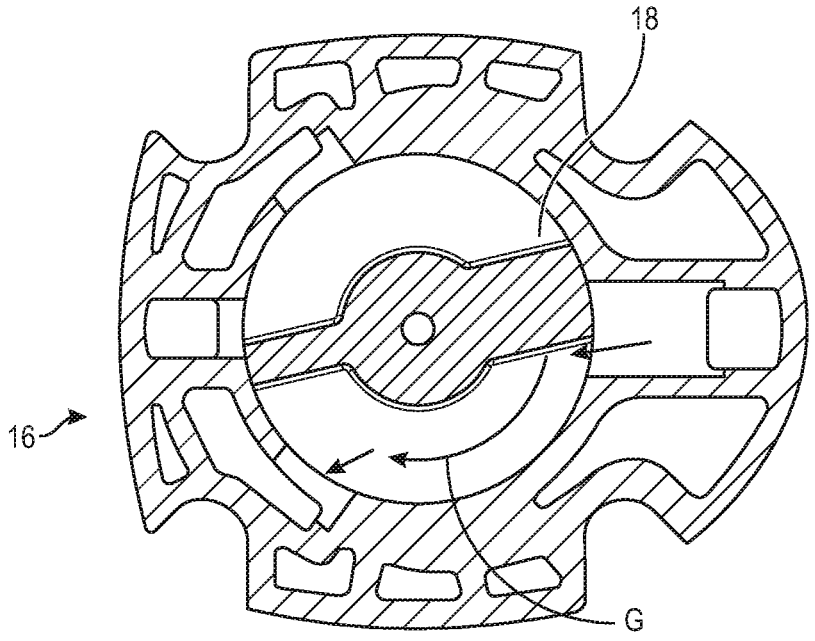
Figure 17D:
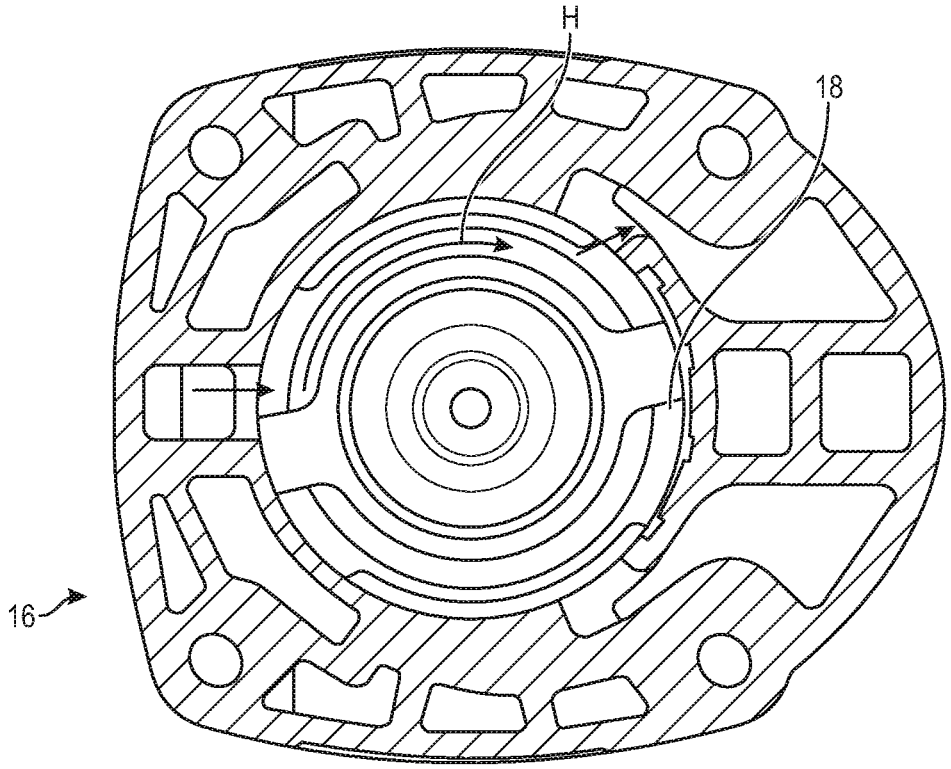

FIGS. 17*a*, 17*b*, 17*c*, and 17*d* show flows of feed gas and exhaust gas directed via regulator 18 at forward high power (FIGS. 17*a* and 17*b*) and at forward low power (FIGS. 17*c* and 17*d*). The flows of feed and exhaust gases are easily seen for settings of reverse high power and reverse low power as regulator 18 is moved to the reverse settings and gas flows are mirrored from those of FIGS. 17*a*, 17*b*, 17*c*, and 17*d*. FIGS. 17*a*-17*d* show a regulator assembly according to embodiments of the present invention without the inclusion of a bushing between the back cap 16 (or housing) and regulator 18.

Figure 11:
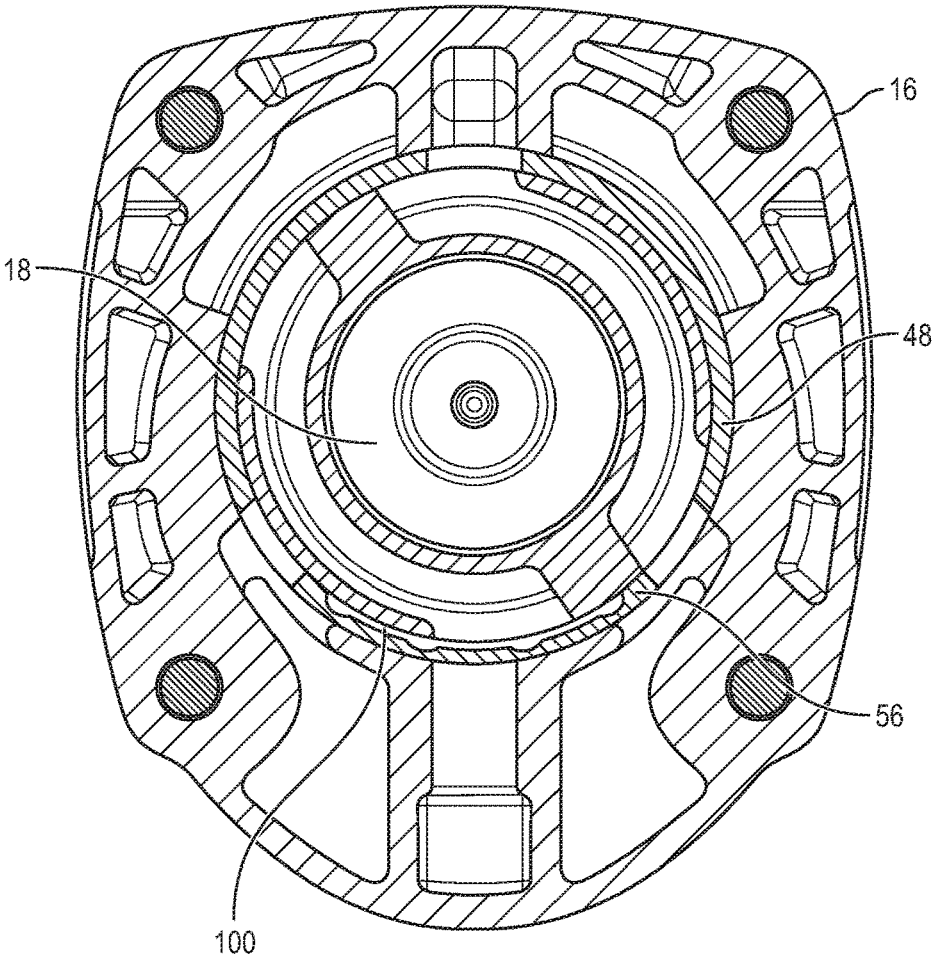
FIG. 11 illustrates a front interior view of a regulator with a back cap, in accordance with at least one embodiment.
Figure 12:
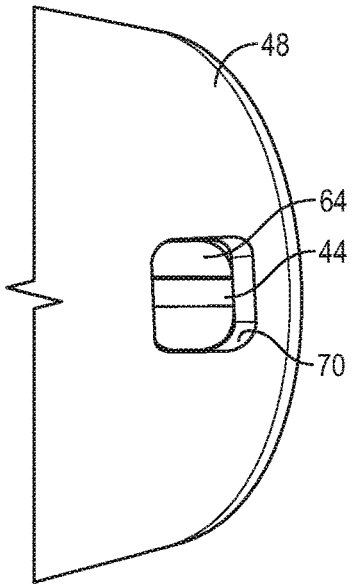
FIG. 12 illustrates an oblique view of a bushing containing a regulator and vane, in accordance with at least one embodiment.

FIG. 11 illustrates a front interior view of a regulator with a back cap in cross-sectional view, in accordance with at least one embodiment.

Figure 13:
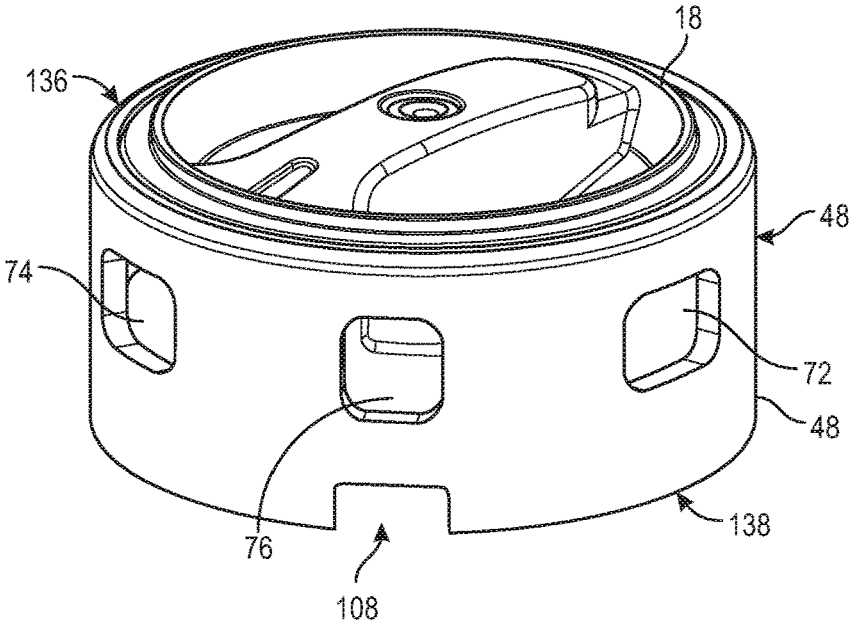
FIG. 13 illustrates an oblique rear view of a regulator and bushing, in accordance with at least one embodiment.
Figure 14:
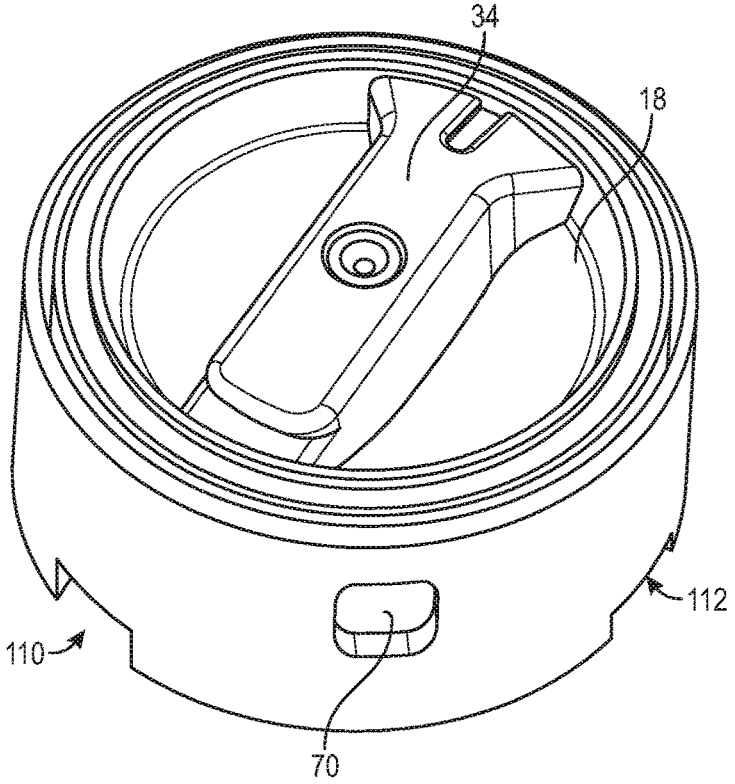
FIG. 14 illustrates an oblique rear view of the regulator and bushing of FIG. 14, in accordance with at least one embodiment.

FIG. 13 illustrates an oblique rear view of a regulator 18 and bushing 48, in accordance with at least one embodiment. Regulator 18 is positioned radially inside bushing 48. Shown are first gas directing orifice 72, second gas directing orifice 73 and third gas directing orifice 76, each of which extend from the radial exterior surface 79 of bushing 48 through bushing 48 and through the radial interior surface 78 of bushing 48. In the embodiment of FIG. 13, bushing 48 comprises an annular ring having a radial interior surface 78, a back bushing surface 136 and a front bushing surface 138 and an axial length 106 extending parallel to axis 86. FIGS. 13 and 14 also show fourth, fifth, and sixth gas directing orifices 108, 110, and 112 positioned along the periphery of front bushing surface 138 and extending through bushing 48. In some embodiments the fourth, fifth, and sixth gas directing orifices 108, 110, 112 may be positioned medially along the axial length of bushing 48 rather than on the periphery of front bushing surface 138.

Bushing 48 may be formed of bronze or other materials. Feed gas orifice 70, first gas directing orifice 72, second gas directing orifice 74, and third gas directing orifice 76 are positioned generally medially along axial length 106 and from back bushing surface 136. In the embodiment of FIG. 13, feed gas orifice 70, first gas directing orifice 72, second gas directing orifice 74, and third gas directing orifice 76 are positioned generally on a plane perpendicular to axis 86. Back bushing surface 136 and front bushing surface 138 may, respectively, be formed on planes perpendicular to axis 86. The fourth, fifth, and sixth gas directing orifices 108, 110, and 112 may also be positioned generally on a separate plane perpendicular to axis 86 and may be positioned on front bushing surface 138.

FIG. 15 illustrates an enlarged rear view of the power tool and regulator of FIG. 1, in accordance with at least one embodiment. In the embodiment shown, regulator 18 can be rotated about axis 86 to align with any of the four positions: reverse high 82, reverse low 83, forward low 84, and forward high 85. The detent system shown in FIG. 16 can serve to provide haptic or tactile feed back to a user of the power tool as regulator 18 is rotated about axis 86. In the embodiment shown, detent receiver section 100 comprises four detent stops 130*a*, 130*b*, 130*c*, and 130*d* extending radially outward from axis 86. Adjacent detent stop 130*a* are first detent shoulder 132 and second detent shoulder 134. First detent shoulder 132 has a lesser radial distance from axis 86 than does second detent shoulder 134. When regulator 18 is positioned in the forward high 85 position, detent pin 56 extends into detent stop 130*a* and first detent shoulder 132 prevents rotation of regulator 18 in the direction of C of FIG. 15 past the position of detent stop 130*a*. Second detent shoulder 134 is of a height and shape that facilitate the forced retraction of detent pin 56 against detent spring 58 and allow rotation of regulator 18 in the direction of D of FIG. 16 to allow regulator 18 to be positioned to detent stop 130*b* (forward low power position 84), or to detent stop 130*c* (reverse low power position 84), or detent stop 130*d* (reverse high power position 86). Detent stops 130*c* and 130*d* are not shown in FIG. 15. Detent stop 130*d* includes a first detent shoulder 132*d* and a second detent shoulder 134*d*. First detent shoulder 132*d* has a lesser radial distance from axis 86 than does second detent shoulder 132*d* such that first detent shoulder 132*d* prevents rotation of regulator 18 in the direction of D of FIG. 15 past the position of detent stop 130*d* (reverse high power position 86). Detent receiver section 100 can be formed in bushing 48 or in back cap 16 depending on the particular embodiment of the invention.

In some embodiments of the present invention comprise bushing 48 positioned between radially inward surfaces of back cap 16 and regulator 18. In some embodiments, no bushing is used.

FIGS. 9 and 17*a* illustrate the regulator in forward high power position 85. As can be seen in FIG. 9, first end 64 of central gas director 62 is positioned so that it does not impede the flow of feed gas from feed gas channel 68 through feed gas orifice 70 into first central cavity 40—this feed gas is then directed between the central gas director 62 and the radial inner surface of bushing 48 to first gas directing orifice 72 into cavity second gas channel 114 of back cap 16 from which it is directed to motor 32 in such a fashion as to facilitate rotation of the motor 32 in a forward direction at high speed. When central gas director 62 is positioned as shown in FIG. 9, vanes 44 and 45 are spring biased against radial inner surface of bushing 48 to prevent feed gas from leaking from first central cavity 40 to second central cavity 41. Arrow set A shows the flow of feed gas through first central cavity 40. After the feed gas has passed through the motor 32, the gas—now exhaust gas—is returned to back cap 16 as described earlier.

It can be seen in the illustration of FIG. 9 that in the embodiment of FIG. 9 feed gas is directed into first central cavity 40 on one side of central gas director 62 while at the same rotation position of regulator 18, exhaust gas is directed through second central cavity 41 ultimately to exhaust channel 11. It can also be seen that at this rotational position of regulator 18, feed gas orifice 70 and first gas directing orifice 72 are entirely unblocked by first end 64 and second end 66, respectively, of central gas director 62, thus allowing high power flow of feed gas through regulator 38 to motor 32.

In FIG. 17*c*, illustrating the regulator 18 at a setting of forward low power 84, the flow of feed gas and exhaust gases are similar to those of FIG. 9 but it should be noted that the first end 64 of central gas director 62 partially blocks feed gas orifice 70 thus partially impeding the flow of feed gas into first central cavity 40 and eventually to motor 32. By thus impeding the flow of feed gas at feed gas orifice 70 a reduced air flow is presented to motor 32 resulting in the power tool 10 operating a low power. As regulator 18 is adjusted and set at reverse high power 82, the position of central gas director 62 will be a mirror of that in FIG. 9, but with feed air entering into second central cavity 41 and exiting second gas directing orifice 74 to be directed to motor 32—now in a reverse flow that rotates motor 32 in the reverse direction. Since, at setting reverse high power 82, first end 64 of central gas director 62 is positioned so that it does not impeded the flow of feed gas from feed gas channel 68 through feed gas orifice 70 into second central cavity 41, full pressure air is presented to motor 32. Similarly, at reverse low power 83, first end 64 of central gas director 62 partially blocks feed gas orifice 70 and thus partially impedes the flow of gas into second central cavity 41 and powering motor 32 at low power.

Feed gas flow is shown in FIG. 17*a* at E and in FIG. 17*c* at G. Exhaust gas flow is shown in FIG. 17*b* at F and in FIG. 17*d* at H.

Figure 22:
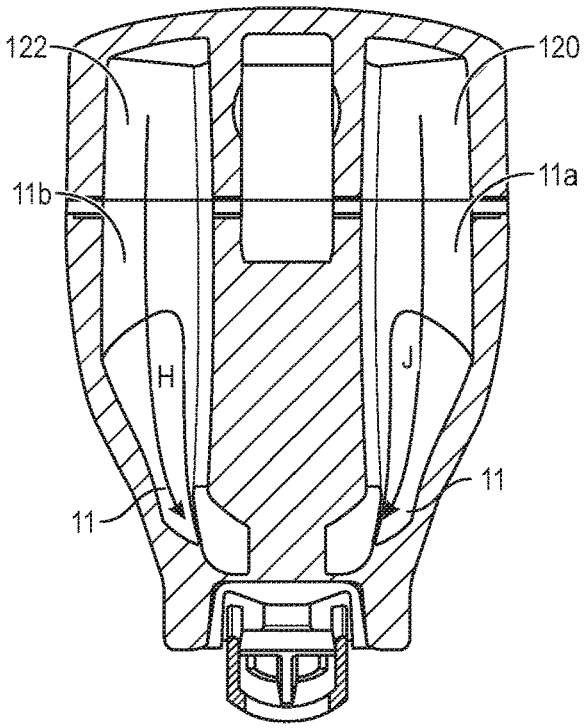
FIG. 22 illustrates a top cross sectional view of the back cap and handle, in accordance with at least one embodiment.

Embodiments of the present invention comprise a novel system which utilizes all aspects of the regulator 18 component. First, back end 26 of regulator 18 comprises grip 34 and facilitates operator rotation of regulator 18 as well as visual indication, as per the embodiment of FIG. 15, of the direction and power setting of the regulator 18. Central portion 27 provides two important functions. It controls the flow of feed gas to either reverse or forward gas channels operatively connected to motor 32 and also receives and redirects exhaust gas from motor 32 to gas conduits or channels (in some embodiments, fourth gas channel 118) that direct the exhaust gasses to the final exhaust gas passageway 11 (via front end 28). Thirdly, the front end 28 of regulator 18 channels the exhaust gasses from gas conduits or channels in communication with the central portion 27 (such as fourth gas channel 118) through exhaust channels (such as 92 and 94) to gas channels (e.g., 120 and 122) eventually to exhaust gas passageway 11. FIG. 22 illustrates a top cross sectional view across line EE of FIG. 2. In some embodiments gas channels 120 and 122 of back cap 16 directly connect to exhaust gas passageway 11, such as shown in FIG. 22 where gas channel 120 is directly connected to exhaust gas passageway 11*a* and exhaust gas flow (shown at H) from gas channel 120 flows to exhaust gas passageway 11*a* (which may be integral with exhaust gas passageway 11), and gas channel 122 is directly connected to exhaust gas passageway 11*b* and exhaust gas flow (shown at J) from gas channel 122 flows to exhaust gas passageway 11*b* (which also may be integral with exhaust gas passageway 11).

Certain advantages are obtained in various embodiments of the present invention. In certain embodiments it is desired provide a user friendly degree of rotation of regulator 18 from one extreme end of the preset range of rotation to the opposite end of rotation while still facilitating the various designed gas flows for the particular embodiment. In the embodiment of FIG. 15 there are shown four separate preset regulator positions. Additionally it is advantageous to minimize the pressure loss of feed gas as it proceeds through the sequential orifices, cavities The sizing and position of orifices 70, 72, 74 and 76 are important and particularly in relation to the cross sectional profile of central cavities 40 or 41 and the sizing of first and second ends 64 and 66 of central gas director 68.

FIG. 19 illustrates an embodiment of an exemplary vane according to certain embodiments. Shown are notches 50 and 51, vane sealing surface 140, vane end wall, and spring seating slot 142. In some embodiments it is advantageous that the vane be tapered such as shown such that the radially external portion of the vane (proximate vane sealing surface) have a greater length 152 than to radially internal portion 154 of the vane (proximate spring seating slot). This tapered shape accommodates free movement of the vane in a radial direction and further facilitates assembly of related components.

FIG. 20 shows a cross sectional view of an exemplary vane according to certain embodiments. Shown are vane 44*b* and vane sealing surface 140*a*. As can be seen vane sealing surface 140*a* is not planar but is arcuate in cross section with the arcuate greater radius section disposed to bear against the radial inner surface 78 of bushing 48 or inner radial surface of back cap 16. In other embodiments, vane sealing surface 140*a* may be triangular in cross section.

In certain embodiments it has been preferred to provide a high power setting of tool 10 which is powered by a 90 psi pressurized air supply. It is also sometimes preferred that a low power setting be provided that produces a low power torque as measured by the power tool 10 output drive of about 65 to 80 percent of the torque of the full power setting, and more preferably at about 75 percent plus or minus 8 percent of full power torque. It is also sometimes preferred that a low power setting be provided that produces a low power free speed of the tool output drive of about 65 to 80 percent of the free speed of the full power setting, and more preferably at about 75 percent plus or minus 8 percent of full power free speed. It has been found that if first end 64, at a low power setting, is sized to, and the degree of rotation of regulator 18 at low power is set to provide that first end 64, block about 84 percent of the area of feed gas orifice 72 that a speed reduction and a torque reduction of generally about 25 percent of full power mode will be achieved. Accordingly, in some embodiments it is preferred that first end 64 block from 80 to 90 percent of the area of feed gas orifice 72, and more preferably to block about 84 percent plus or minus 2 percent of the area of feed gas orifice 72. Moreover, in some embodiments, it has been found that the relative circumferential widths (or lengths) of first end 64 and second end 66 be in a ratio of from 2/1 to 4/1 and more preferably in a ratio of generally about 3/1. It has also been found that with the above mentioned width ratios and desired power reduction, that the regulator 18 be rotated about 35 degrees from top dead center (as shown by the center of orifice 76) at full power setting and about 9.3 degrees (plus or minus 2 degrees) from top dead center at reduced power mode. Moreover, it has been found that to provide preferred performance in certain embodiments of the present invention that the center of each of orifices 72 and 74 be displaced generally about 55 degrees in opposite directions from the center of third gas directing orifice 76. In certain embodiments it has been found that to achieve a 20 percent reduction in power or free speed it is preferred to provide that first end 64 block about 80 percent of the area of feed gas orifice 70. To facilitate a desired pressure drop through the feed gas flow systems it has been found that the ratio of areas of feed gas orifice 70 to that of orifices 72 and 74 be generally in the order of or approximately about 11 to 16.

In some embodiments it is generally desired that the pressure drop such as from feed gas channel 68 until entry of feed gas into second gas channel 114 or third gas channel 116 (depending on forward or reverse operations) be minimal and fairly linear and/or consistent. It has been found that for a 90 psi feed gas at full power operations, a reduction of about 1.5 psi occur in the length from the feed gas coupling 13 to the end cap 16, that a reduction of generally about 1.3 psi occur from the end cap 16 through feed gas channel and into central cavity 40 or 41, and that a reduction of generally about 1.6 psi occur during gas flow from central cavity 40 or 41 through first or second gas directing orifices 72 or 74, with a total pressure reduction from geed gas coupling 13 through first or second gas directing orifices 72 or 74 of about 4 to 5.5 psi.

In certain embodiments, bushing 48 may be press fit into back cap 16 or housing. In some embodiments, including some in which bushing 48 comprises aluminized bronze and back cap 16 comprises cast aluminum it is preferred that the outer diameter of bushing 48 be about 0.045 mm larger than the internal diameter of the cavity in back cap 16 into which the bushing will be press fit (for a bushing having an outer diameter of about 73 mm and the back cap cavity having an internal diameter of about 71.955 mm, such that the outer diameter of bushing is approximately be approximately 1.015 (plus or minus 0.011) times the internal diameter of the back cap cavity.

The configuration of embodiments of the present invention provide economies of manufacture. For example, bushing 48 may be formed by cutting piping comprised of the appropriate brass alloy and having the designed general target internal and external diameters for the bushing 48. The surfaces of back bushing surface 134 and 136 are formed and prepared and the various orifices of the bushing are machined out. After those operations are completed the radial inner surface 78 of bushing 48 may be machined and surface finished and the radial exterior surface 79 of bushing 48 may also be machined and surface finished. Since these internal and external machining steps may create burrs associated with the orifices, after the machining and surface finishing steps, the orifice openings may be chamfered either on the radial interior portion of the orifice openings, on the radial exterior portion of the orifice openings or on both the radial interior and exterior portions of the orifice openings.

The material selection criteria for the bushing may include the following considerations or objectives: that the material not rust, that there be no lead in the material, that the material have a high hardness, and that the material be economically machinable. In some embodiments, it is preferred to use an aluminized bronze material for the bushing that contains no lead that has a tensile strength of between 65,000 psi and 105,000 psi and more preferably generally about 85,000 psi plus or minus 10,000 psi. In some embodiments it is also preferred to us an aluminized bronze material having a hardness of generally about B85. In some embodiments the bushing material may be aluminized bronze product C95400 with ASTM B505 and, in some embodiments, B505M. In some embodiments the housing or back cap 16 of power tool 10 or other housing may comprise cast aluminum. It may be important in certain embodiments that the tool or regulator assembly have a drop safety adequate for rigorous use. By use of the above described aluminized bronze material, or others of similar strength and hardness characteristics, the regulator is preferably protected from tool dropping so that if the tool is dropped the bushing has sufficient strength that is will not go out of round and the integrity of the regulator system maintained. In some embodiments the bushing material may have a tensile strength and hardness exceeding that of the back cap or housing. Additionally the bushing may be press fit into the back cap or housing. The heightened tensile strength and/or hardness of the bushing material serves to protect the integrity of the bushing shape during the press fit operation so that the machined round shape of the bushing is maintained intact during assembly. The combination of a strong bronze bushing with an aluminum back cap provides advantages including strength where it is needed (in the bushing to maintain the shape of the bushing and tight seals with the vanes) and weight savings and economics in the aluminum back cap or housing where lesser strength may be offset by weight savings and/or economics.

In certain embodiments it is preferred to machine and finish the radial inner surface 78 of bushing 48 to a surface roughness of 20 to 62 microinches, or more preferably generally about 32 plus or minus 8 microinches. This reduced surface roughness level provides efficient sealing with the vanes and reduces abrasion to the vanes. In certain embodiments, the vanes may comprise a plastic material, a thermoplastic material, a thermoplastic composite material, a material having reduced or low friction characteristics, a metal, a Teflon component, or other material. In certain embodiments, the vanes may comprise a material having a hardness less than the hardness of the radial inner surface 78 of bushing 48. It has been found that in certain embodiments a material having the characteristics of LNP Lubricomp Compound SX93441D may be advantageous for formation of the vanes. It is of benefit that the material of the vanes be minimally affected by moisture, organics, and other contaminants that may be in the gasses of the system, that they have a heightened resistance to wear, that they not rust, not present adverse galvanic complications with adjacent materials, that if molded they resist warping when cooling or curing. In some embodiments the fit between vane and vane slots in the regulator is very tight (to reduce or prevent gas leakage through loose fit of these components). Accordingly, it is important that the material of the vane, if a molded material, be one that is very stable and has a high resistance to warping or shrinking after being molded as well as a low moisture absorptivity. SX93441D has been found to provide preferred performance as a vane material in certain embodiments.

In some embodiments the biased vane structure may not be included and instead the diameter of the radial external surface 79 of bushing 48 may be increased in the axial length between the first and second O-rings.

In some embodiments more than two O-rings may be utilized in conjunction with the regulator such as when it is desired that separate axial regions of the regulator be isolated from gas flow from adjacent axial regions.

In some embodiments the regulator of the present invention may be configured to only provide a control of feed gas pressure or volume by rotation of the regulator. In some embodiments the regulator may be configured to provide only a directional control of the motor 32 by rotation of the regulator.

Although the invention has been described with reference to specific embodiments, it will be understood by those skilled in the art that various changes can be made without departing from the spirit or scope of the invention. Accordingly, the disclosure of embodiments is intended to be illustrative of the scope of the invention and is not intended to be limiting. It is intended that the scope of the invention shall be limited only to the extent required by the appended claims. To one of ordinary skill in the art, it will be readily apparent that systems and methods discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one embodiment, and may disclose alternative embodiments.

What is claimed is:

1. A radial seal regulator system for a power tool, comprising:

a housing including a back cap, the back cap having a cylindrical opening around a central axis, wherein the central axis is coaxial with a drive axis of the power tool, and wherein the back cap defines a feed gas channel, a second gas channel, a third gas channel, and a fourth gas channel;

a bushing configured to fit inside said cylindrical opening;

a regulator having an axial length, a front end, and a back end, and an axially central section comprising a first central cavity and a second central cavity, wherein the regulator is configured to fit inside said bushing and rotate around the central axis;

said bushing having a feed gas orifice, a first gas directing orifice, a second gas directing orifice and a third gas directing orifice, wherein said regulator regulates a flow of gas and directs the flow of gas to one of a forward gas channel or a reverse gas channel connected to a motor of the power tool based on the relative position between the bushing and the feed gas channel, the second gas channel, the third gas channel, and the fourth gas channel.

2. The system of claim 1 wherein said first and second central cavities are separated by a central gas director that extends along a diameter of said regulator.

3. The system of claim 2, wherein the regulator includes a first vane and a second vane disposed respectively in a first slot and a second slot, wherein the first vane and the second vane axially extend between the front end and the back end.

4. The system of claim 3, wherein the regulator further includes a first spring and a second spring disposed respectively in a first spring recess and a second spring recess, the first spring and the second spring respectively biasing the first vane and the second vane in a radially outward direction towards the bushing, wherein the first vane and the second vane seal against a radial inner surface of the bushing.

5. The system of claim 4, wherein the first vane and the second vane prevent flow of the feed gas from the first central cavity into the second central cavity.

6. The system of claim 4, wherein the regulator includes a first O-ring and a second O-ring disposed respectively in a first O-ring groove and a second O-ring groove, wherein the first O-ring groove and the second O-ring groove extend circumferentially around the regulator.

7. The system of claim 6, wherein the first O-ring and the second O-ring prevent a flow of gas in an axial direction out of the first central cavity and the second central cavity.

8. The system of claim 1, wherein the regulator includes a grip disposed on the back end of the regulator to facilitate rotation of the regulator within the bushing by an operator and change the direction of the gas flow to the motor between the one of the forward gas channel or the reverse gas channel.

9. A power tool system including a radial seal regulator comprising:

a drive mechanism for powering a working tool element, the drive mechanism including:

a drive body having a drive axis;

a handle connected to the drive body a housing for supporting and retaining the drive mechanism, the housing including a back cap, the back cap having a cylindrical opening having a central axis, wherein the central axis is coaxial with a drive axis of the drive body, and wherein the back cap defines a feed gas channel, a second gas channel, a third gas channel, and a fourth gas channel;

a bushing configured to fit inside said cylindrical opening;

a regulator having an axial length, a front end, and a back end and configured to fit inside said bushing, the regulator rotatable around the central axis;

said bushing having a feed gas orifice, a first gas directing orifice, a second gas directing orifice and a third gas directing orifice, wherein said regulator regulates a flow of gas and directs the flow of gas to one of a forward gas channel or a reverse gas channel connected to a motor of the power tool based on the relative position between the bushing and the feed gas channel, the second gas channel, the third gas channel, and the fourth gas channel.

10. The system of claim 9 wherein said first and second central cavities are separated by a central gas director that extends along a diameter of said regulator.

11. The system of claim 10, wherein the regulator includes a first vane and a second vane disposed respectively in a first slot and a second slot, wherein the first vane and the second vane axially extend between the front end and the back end.

12. The system of claim 11, wherein the regulator further includes a first spring and a second spring disposed respectively in a first spring recess and a second spring recess, the first spring and the second spring respectively bias the first vane and the second vane in a radially outward direction towards the bushing, wherein the first vane and the second vane seal against a radial inner surface of the bushing.

13. The system of claim 12, wherein the first vane and the second vane prevent flow of the feed gas from the first central cavity into the second central cavity.

14. The system of claim 12, wherein the regulator includes a first O-ring and a second O-ring disposed respectively in a first O-ring groove and a second O-ring groove, wherein the first O-ring groove and the second O-ring groove extend circumferentially around the regulator.

15. The system of claim 14, wherein the first O-ring and the second O-ring prevent a flow of gas in an axial direction out of the first central cavity and the second central cavity.

16. The system of claim 9, wherein the regulator includes a grip disposed on the back end of the regulator to facilitate rotation of the regulator within the bushing by an operator and change the direction of the gas flow to the motor between the one of the forward gas channel or the reverse gas channel.

* * * * *